US005654107A

United States Patent [19]

Tanaka et al.

[11] Patent Number: 5,654,107

[45] Date of Patent: Aug. 5, 1997

[54] WEAR RESISTING ALUMINUM ALLOY COMPOSITE MATERIAL

[75] Inventors: Tadashi Tanaka; Masaaki Sakamoto; Koichi Yamamoto; Yoshiaki Sato; Eiji Kato, all of Nagoya, Japan

[73] Assignee: Daido Metal Company Ltd., Nagoya, Japan

[21] Appl. No.: 539,697

[22] Filed: Oct. 5, 1995

[30] Foreign Application Priority Data

Oct. 19, 1994 [JP] Japan ..... 6-281227

[51] Int. Cl.[6] ..... B21D 39/00

[52] U.S. Cl. ..... 428/614; 148/415; 148/437

[58] Field of Search ..... 428/614; 148/415, 148/437

[56] References Cited

U.S. PATENT DOCUMENTS 5,449,421 9/1995 Hamajima et al. ..... 148/415

FOREIGN PATENT DOCUMENTS 0 394 056 A1 4/1990 European Pat. Off. .
4-350135 4/1992 Japan .
4-350136 4/1992 Japan .

*Primary Examiner*—James J. Bell
*Attorney, Agent, or Firm*—Browdy and Neimark

[57] ABSTRACT

A wear resisting aluminum alloy composite material consisting of 10 to 40% by volume of a hybrid compact and the balance substantially an aluminum alloy matrix, wherein the hybrid compact contains 85 to 95% by weight of an inorganic whisker which is 0.2 to 1.2 μm in diameter and 10 to 30 μm in length, and 5 to 15% by weight of an alumina fiber which is 100 to 300 μm in length, and the aluminum alloy matrix contains 4 to 12% by weight of a silicon having an average grain size of not more than 5 μm. The composite material offers good properties such as anti-seizure property and wear resistance. The composite material is suitable for sliding members. Aluminum borate whisker and potassium titanate whisker may be preferably used as the inorganic whisker.

6 Claims, 1 Drawing Sheet

WEAR RESISTING ALUMINUM ALLOY COMPOSITE MATERIAL

BACKGROUND OF THE INVENTION

1. Field of the Invention

The present invention relates to a wear resisting aluminum alloy composite material.

2. Description of the Related Art

In general, rotors and vanes and so on of a rotary compressor slide and rotate in a rotary cylinder. Improved sliding characteristics as well as light weight have been required for the sliding members used at higher speeds. Therefore, various composite materials which comprise an aluminum alloy including reinforcing fibers as reinforcement have been developed as shown in the prior arts explained below.

JP-A-4-350135 discloses a combination of sliding members such as a vane member and a rotor member for a rotary compressor, in which the first member is made of an aluminum composite siding material comprising a hybrid compact of both aluminum borate whisker and alumina fiber which hybrid compact is impregnated with aluminum alloy. The second member is made of a cast iron material which is perforated for reducing the weight thereof. In the first sliding member, the mixing ratio of the aluminum borate whisker to the alumina fiber is in the range of 0.5 to 2.0, and the impregnated aluminum alloy contains 20 to 30% silicon. In the first prior art, it is disclosed that, by using the combination, it becomes possible to reduce the damage of a cast iron counterpart member, that is, to reduce the attacking property of the first member against the counterpart member.

In the first member of the first prior art (JP-A-4-350135) which is made of the hybrid compact comprising an aluminum borate whisker and an alumina fiber, the formability of the hybrid compact is obtained by mixing 33 to 67% alumina fiber. However, the sliding member of the hybrid compact impregnated with the aluminum alloy has such a drawback as the sliding member severely attacks a counterpart member due to high hardness of the alumina fiber. Furthermore, 20 to 30% by weight of silicon, which is added in the impregnated aluminum alloy in order to obtain wear resistance and low thermal expansion, causes low toughness of the alloy due to hard and brittle coarse primary crystal silicon particles precipitated therein.

JP-A-4-350136 discloses a sliding material comprising 20 to 80% by volume of reinforcing fiber which is a mixture of both aluminum borate whisker and aluminum fiber and which is impregnated with an aluminum alloy. The sliding member of the second prior art also causes unfavorably severe attacking against a counter-part member because the hybrid compact may contain 20 to 80% of alumina fiber.

These conventional hybrid compacts do not bring about satisfactory sliding characteristics, such as anti-seizure property and wear resistance, because the high content of the alumina fiber is mixed in the hybrid compact in order to obtain shape-keeping-property (, that is, rigidity).

SUMMARY OF THE INVENTION

It is an object of the present invention to provide an aluminum alloy composite material having excellent sliding characteristics such as anti-seizure property and wear resistance and so on which are essential for a sliding member.

According to the first aspect of the present invention there is provided a wear resisting aluminum alloy composite material consisting of a hybrid compact of 10 to 40 by volume % and the balance substantially being an aluminum alloy matrix, the hybrid compact containing a mixture of inorganic whisker having diameter of 0.2 to 1.2 μm and length of 10 to 30 μm and alumina fiber having length of 100 to 300 μm, the ratios of the inorganic wisker and alumina fiber both contained in the mixture being 85 to 95 wt.% and 15 to 5 wt.% respectively, the aluminum alloy matrix containing 4 to 12 wt.% silicon having an average particle size of not more than 5 μm and the balance substantially aluminum. According to the second aspect of the invention, the inorganic whisker is aluminum borate whisker and/or potassium titanate whisker. According to the third aspect of the invention, the aluminum matrix further contains, by weight, not more than 4.5% Cu, not more than 3% Mg, and not more than 3% Ni.

Then, the function of each component in each of the matrix and the hybrid compact is explained below.

A. Matrix

Silicon added in the aluminum alloy matrix acts to improve wear resistance and creep resistance and to make thermal expansion low. Silicon added in the matrix is 4 to 12% by weight. A low silicon content of less than 4% does not bring about satisfactory wear resistance. A high silicon content of more than 12% causes decrease in the impact resistance due to brittle primary crystal silicon precipitated from the matrix.

The size of the silicon crystal particles is made to be not more than 5 μm, and preferably in the range of 2 to 4 μm, because large Si particles of more than 5 μm embrittle the matrix.

Copper, magnesium or nickel may be preferably added in the matrix in order to reinforce the matrix and to make silicon crystal particles fine in size. The addition content thereof is not more than 4.5% for copper, and not more than 3% for each of magnesium and nickel.

Copper exists in a solid-solution state in the matrix, so that the strength of the matrix is improved. Furthermore, copper makes silicon crystal particles fine in size and brings about improvement in the mechanical properties such as hardness, tensile strength, and wear resistance. In a case where the copper content exceed 4.5%, the matrix becomes brittle and the castability thereof decreases, so that the copper content should not exceed 4.5%. Preferably, the copper content is 0.5 to 4.5%.

Magnesium exists in a solid-solution state in the matrix or precipitates in the state of intermetallic compound ($Mg_2Si$), so that magnesium enhances the tensile strength, hardness and wear resistance of the matrix. A magnesium content of less than 0.1% can not bring about these effects. On the other hand, in a case where the magnesium content exceeds 3%, the castability thereof becomes inferior. Thus, the magnesium content is 3% or less, and is preferably 0.1% to 3%.

The addition of nickel brings about increase in the tensile strength, hardness and wear resistance of the matrix because of the reinforcement of the matrix and an improvement in wear resistance. However, nickel content more than 3% deteriorates the castability. Thus, the Ni content is not more than 3% and is preferably 0.1 to 3%.

B. Hybrid compact

The inorganic whisker comprise an aluminum borate whisker and/or potassium titanate whisker, both of which whiskers is superior in lubricating characteristics and has less attacking characteristic against a counterpart member. The preferable size of the in-organic whisker is 1.2 μm or less in diameter and 30 μm in length.

The preferable size of the alumina fiber is 100 to 300 μm in length and is 1 to 6 μm in diameter. The long alumina fiber and short inorganic whisker entangle each other to thereby form a mixture by mixing them with each other, so that a hybrid compact having good shape-keeping-property (, i.e., rigidity) can be obtained. In the mixture of the hybrid compact, the weight ratios of the inorganic wisker and alumina fiber is 85 to 95% and 15 to 5%, respectively. An alumina fiber content of over 15% causes poor anti-seizure properties and increased attacking against the counter-part member. In the case of the alumina fiber content being less than 5%, the hybrid compact can not maintain its shape-keeping-property, so that the hybrid compact causes a permanent strain and separates into the two layers while molten aluminum metal is poured therein, with the result that it becomes impossible to obtain the composite material impregnated with the aluminum alloy.

The composite material consists of the hybrid compact of 10 to 40 by volume % and the aluminum alloy matrix of 90 to 60 by volume %. A hybrid compact content less than 10 by volume % causes poor wear resistance and poor shape-keeping-property of the composite material, however, on the other hand, the composite material becomes brittle in the case of a high hybrid compact content of more than 40 by volume %. Preferably, the hybrid compact content is in the range of 15 to 30 by volume %.

BRIEF DESCRIPTION OF TEE DRAWINGS

FIG. 1 is a plan view of a test piece used in tests for confirming various characteristics; and FIG. 2 is a cross-section taken along line I—I in FIG. 1.

DESCRIPTION OF THE PREFERRED EMBODIMENTS

The present invention is explained in connection with preferred embodiments disclosed below.

First, a hybrid composite was prepared in order to obtain testing materials regarding examples embodying the invention and comparative examples. Aluminum borate whisker and potassium titanate whisker were selected as the inorganic whisker. The aluminum borate whisker and potassium titanate whisker used in the experiments had 0.5 μm in average diameter and 20 μm in average length. Alumina fiber had an average diameter of 3 μm and an average length of 200 μm. Alumina sol or silica sol of 1 to 8% by weight in terms of solid content was used as a binder. These raw materials having such mixing ratios as shown in Table 1 were poured into an aqueous solution and were stirred so that the inorganic whisker and the alumina fiber were dispersed and mixed. The mixture was poured into a mold through a suction pump and was aggregated so that the mixture had a predetermined volume ratio. Then, it was dehydrated with a press while adjusting the volume ratio. After drying, the mixture was baked at 1,100° C. to make a hybrid compact having the shape-keeping-property.

Figure 1:
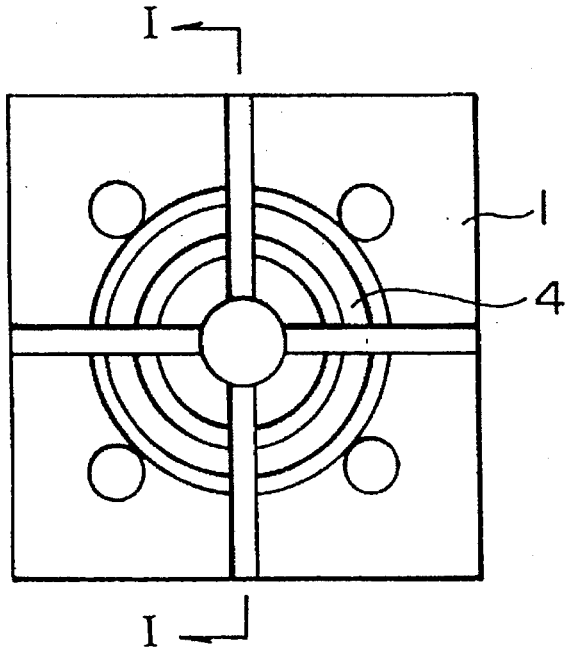
Figure 2:
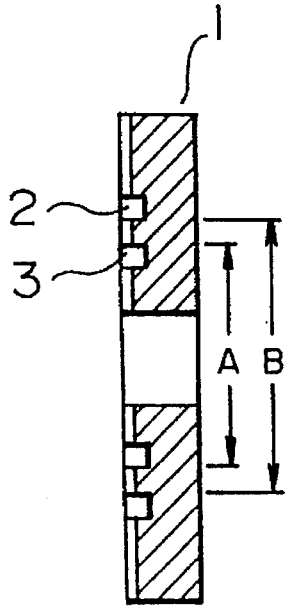

The hybrid compact obtained was placed into the mold preheated up to 250° C., molten aluminum alloy having a chemical composition of matrix shown in Table 1 was poured into the mold, and they were immediately pressed at 1,000 kgf/cm2 to produce a disk-shaped cast article. The cast article was subjected to "T6 treatment" (solution heat treatment at 520° C., and artificial aging at 170° C. for 7 hours), and was shaped by machining to the shape shown in FIG. 1 and FIG. 2. The resulting test piece had a ring-shaped sliding surface 4 having inner diameter A and outer diameter B which sliding surface 4 was defined between two ring grooves 2 and 3. The test pieces for Example 1 to 9 and Comparative Example 10 to 15 were prepared by using these steps.

TABLE 1

| | | Ratio of Reinforcement in Hybrid compact | | | | | | | | | |
|---|---|---|---|---|---|---|---|---|---|---|---|
| | | Inorganic Whisker (wt %) | | | Volume Percent | Chemical Composition of Matrix (wt %) | | | | | Average Particle Size of Si |
| Kind | No. | Potassium Titanate Whisker | Aluminum Borate Whisker | Aluminum Fiber (wt %) | of Hybrid Compact | Si | Cu | Mg | Ni | Al | (μm) |
| Example of the Invention | 1 | — | 95 | 5 | 30 | 12 | 1 | 3 | — | Bal. | 4 |
| | 2 | — | 90 | 10 | 20 | 9 | 3 | — | — | Bal. | 2 |
| | 3 | 5 | 85 | 10 | 20 | 10 | 3 | 0.5 | — | Bal. | 3 |
| | 4 | 85 | — | 15 | 10 | 10 | 2 | — | 0.5 | Bal. | 2 |
| | 5 | — | 85 | 15 | 15 | 7 | — | 0.5 | 3 | Bal. | 2 |
| | 6 | 90 | — | 10 | 40 | 4 | 3 | — | — | Bal. | 1 |
| | 7 | — | 90 | 10 | 30 | 12 | — | — | — | Bal. | 5 |
| | 8 | — | 95 | 5 | 40 | 4 | — | — | — | Bal. | 2 |
| | 9 | 60 | 30 | 10 | 20 | 10 | 3 | 0.5 | — | Bal. | 3 |
| Comparative Example | 10 | 80 | — | 20 | 40 | 12 | 1 | 3 | — | Bal. | 3 |
| | 11 | — | 75 | 25 | 20 | 7 | — | 0.5 | 3 | Bal. | 2 |
| | 12 | 100 | — | — | 10 | 10 | 3 | 1 | — | Bal. | 2 |
| | 13 | — | 85 | 15 | 10 | 17 | 3 | 0.5 | — | Bal. | 8 |
| | 14 | 90 | — | 10 | 15 | 2 | 1 | 0.5 | — | Bal. | 1 |
| | 15 | — | 70 | 30 | 20 | 9 | 3 | — | — | Bal. | 2 |

Seizure tests were performed for the test pieces of Example of the invention 1 to 9 and Comparative Example 10 to 15, in which seizure tests the Suzuki wear testing machine disclosed in JP-A-2-80813 was used for evaluating anti-seizure characteristics under the conditions shown in Table 3 and Table 4. In the seizure test, after subjecting the test pieces to running-in, static load was gradually increased. Maximum load without seizure was determined by measuring the load at the time when the rear surface temperature of the test piece exceeded 200° C. or the friction force reached 50 kgf.cm. The results are shown in Table 2.

TABLE 2

| Kind | No. | Seizure Test Results: Maximum Load without Seizure (MPa) 3 6 9 12 15 18 | Wear Test Results: 0.02 0.04 0.06 | Wear Test Results: Wear Amount of Counterpart Member (μm) 10 15 20 25 |
|---|---|---|---|---|
| Example of the Invention | 1 | | | |
| | 2 | | | |
| | 3 | | | |
| | 4 | | | |
| | 5 | | | |
| | 6 | | | |
| | 7 | | | |
| | 8 | | | |
| | 9 | | | |
| Comparative Example | 10 | | | |
| | 11 | | | |
| | 12 | | | |
| | 13 | | | |
| | 14 | | | |
| | 15 | | | |

TABLE 3

| | |
|---|---|
| Dimension of Bearing | Outer Diameter: 27.2 mm<br>Inner Diameter: 22.0 mm |
| Rotation Speed | 1500 rpm |
| Circumferential Speed | 2.0 m/s |
| Lubricating Oil | SAE #10 |
| Temperature | Room Temp. |
| Method | Oil bath |
| Kind of Shaft Material | S55C |
| Roughness | 0.3–0.4 Rmax. μm |
| Hardness | 500–600 Hv5 |

TABLE 4

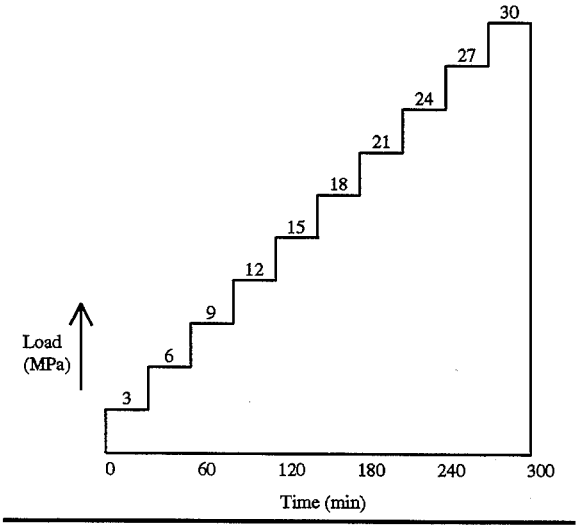

As shown in Table 2, the test pieces in Comparative Example 11 and 15 which were obtained from the hybrid compacts containing 75 or 70% by weight aluminum borate whisker as a inorganic whisker had poor anti-seizure property i.e. the maximum load of 6 MPa. On the other hand, the results in Example of the Invention 1 to 9 showing a maximum load of more than 9 MPa had the good anti-seizure property. Especially, the test pieces of Example of the Invention 1 and 2 show the excellent anti-seizure property, i.e. the maximum load of 15 MPa.

The wear testing was performed under the conditions shown in Table 5.

TABLE 5

| | |
|---|---|
| Dimension of Bearing | Outer Diameter: 27.2 mm<br>Inner Diameter: 22.0 mm |
| Rotation Speed | 1500 rpm |
| Circumferential Speed | 2.0 m/s |
| Specific Load of Test | 6 (Constant) MPa |
| Time Period of Test | 20 Hr |
| Lubricating Oil | SAE #10 |
| Temperature | Room Temp. |
| Method | Oil bath |
| Kind of Shaft Material | S55C |
| Roughness | 0.3–0.4 Rmax. μm |
| Hardness | 500–600 Hv5 |

The results are shown in Table 2. The wear amounts of a test piece and a counterpart member in sliding-contact with the test piece were measured by the difference of the disk thickness between the disk thickness value before test and that after the test.

As shown in Table 2, the test piece of Comparative Example 12 containing 100% of the potassium titanate whisker and not containing the alumina fiber had poor wear resistance. The test piece of Comparative example 14 containing only 2% of silicon in the metal matrix also had poor wear resistance.

In the case of Comparative Example 10, 11 and which contain more than 20% of aluminum short fiber in the hybrid compacts, the wear amount of the counterpart member in sliding-contact with each test piece was large due to high content of hard alumina fiber. In Comparative Example 13 containing 17% silicon in the metal matrix, the average size of the primary crystal silicon particles grows up to 8 μm, so that the large wear amount of the counterpart member is caused due to the coarse silicon particles.

The test pieces of Examples 1 to 9 based on the invention had both good anti-seizure property and wear resistance as shown in Table 2.

What is claimed is:

1. A wear resisting aluminum alloy composite material consisting of a hybrid compact of 10 to 40 by volume % and the balance substantially being an aluminum alloy matrix, said hybrid compact containing a mixture of inorganic whisker having diameter of 0.2 to 1.2 μm and length of 10 to 30 μm, and an alumina fiber having length of 100 to 300

μm, the ratios of said inorganic wisker and alumina fiber both contained in the mixture being 85 to 95 by weight % and 15 to 5 by weight % respectively, and said aluminum alloy matrix containing 4 to 12% by weight of a silicon having an average grain size of not more than 5 μm and the balance substantially aluminum.

2. A wear resisting aluminum alloy composite material according to claim 1, wherein the inorganic whisker is at least one selected from the group consisting of aluminum borate whisker and potassium titanate whisker.

3. A wear resisting aluminum alloy composite material according to claim 1, wherein the aluminum alloy matrix further contains at least one selected from the group consisting of not more than 4.5% copper, not more than 3% magnesium, and not more than 3% nickel.

4. A wear resisting aluminum alloy composite material according to claim 1, wherein the hybrid compact is impregnated with the aluminum alloy matrix.

5. A wear resisting aluminum alloy composite material according to claim 2, wherein the aluminum alloy matrix further contains at least one metal selected from the group consisting of not more than 4.5% copper, not more than 3% magnesium, and not more than 3% nickel.

6. A wear resisting aluminum alloy compositor material according to claim 2, wherein the hybrid compact is impregnated with the aluminum alloy matrix.

* * * * *